United States Patent [19]

Finlan

[11] Patent Number: 5,017,882

[45] Date of Patent: May 21, 1991

[54] PROTON SOURCE

[75] Inventor: Martin F. Finlan, Buckinghamshire, England

[73] Assignees: Amersham International plc, Buckinghamshire; Oxford Instruments Ltd., Oxford, both of England

[21] Appl. No.: 396,624

[22] Filed: Aug. 22, 1989

[30] Foreign Application Priority Data

Sep. 1, 1988 [GB] United Kingdom ..... 8820628

[51] Int. Cl.[5] ..... H05H 13/00; H05H 31/10

[52] U.S. Cl. ..... 328/234; 313/62

[58] Field of Search ..... 328/234; 313/62

[56] References Cited

U.S. PATENT DOCUMENTS 3,794,927 2/1974 Fleischer et al. ..... 328/234 X
3,868,522 2/1975 Bigham et al. ..... 313/62

FOREIGN PATENT DOCUMENTS 3148100 6/1983 Fed. Rep. of Germany .
WO8607229 12/1986 PCT Int'l Appl. ..... 328/234

OTHER PUBLICATIONS

W. Joho, IEEE Transactions on Nuclear Science, "Astor, Concept of a Combined Acceleration and Storage Ring for the Production of Intense Pulsed or Continuous Beams of Neutrinos, Pions, Muons, Kaons and Neutrons", Aug. 1983.

P. A. Smith, Nuclear Instruments and Methods, "Possible Methods for Improving the Resolution of Neutron Time-of-Flight Measurements of Direct Reaction Spectra", 7/1979.

*Primary Examiner*—Sandra L. O'Shea
*Attorney, Agent, or Firm*—Wenderoth, Lind & Ponack

[57] ABSTRACT

In a proton/neutron source incorporating a cyclotron, in particular a superconducting cyclotron having a cylindrical superconducting magnet incorporating superconducting magnetic coils associated with pole pieces, a stream of ionized particles, such as $H^-$ particles, is continuously injected into the center of the cyclotron beam space and is accelerated outwards in a spiral path under the combined effect of the magnetic field from the superconducting magnet, and RF energization applied to sector-shaped electrodes. When the particles reach the required energy, they are removed from the spiral path by septa electrodes, and are passed across a proton storage ring in a path of rapidly increasing radius under the influence of the falling magnetic field of the superconducting magnets. A certain distance out from the center of the cyclotron, the magnetic field reverses, and the particles turn anticlockwise and enter a bending magnet in which the route of the particles is bent back towards the cyclotron so that they eventually enter the proton storage ring. As they enter the ring, the particles are stripped of their electrons so that they become positively charged protons, which protons will circulate continuously round the storage ring until required. Extraction from the ring may, for example, be effected by septa electrodes.

13 Claims, 3 Drawing Sheets

PROTON SOURCE

BACKGROUND OF THE INVENTION

The present invention relates to a proton source incorporating a cyclotron. Cyclotrons are devices for accelerating a beam of ionized particles around a substantially spiral path lying normal to an axial magnetic field, so as to produce a continuous output beam of particles at the high energy levels required for research and other purposes involving ion bombardment.

In a cyclotron, a beam of ionized particles travels past accelerating electrodes which are paired to have opposing electrical voltages applied to them. With each transition of the ionized particles past the differential voltage of a pair of electrodes, the particles gain energy. The voltages applied to the electrodes are alternating voltages of radio frequency and are applied at a frequency synchronized with the transitions of the ionized particles. By causing the ionized particles to travel in a roughly circular path which lies normal to an axial magnetic field, the particles can be made to make numerous transitions past a small number of electrode pairs receiving acceleration and gaining in radius at each transition.

The present invention addresses the problem of using the cyclotron to produce a high current pulsed proton beam either to inject into another accelerator to give higher energies, or to provide an intense pulsed source of neutrons.

SUMMARY OF THE INVENTION

The basic apparatus according to the invention takes the form of a pulsed proton source comprising a cyclotron having an input source of negatively ionized particles, a proton storage ring coaxial with the cyclotron, means for directing the accelerated output particles from said cyclotron along a route which in a first stage passes radially outside said proton storage ring, in a second stage is bent back towards the proton storage ring and in a third stage is passed tangentially into said proton storage ring, and means at the point of entry of the accelerated particles into the storage ring for converting said negatively ionized particles into protons.

Suitably negatively ionized particles include those of hydrogen ($H^-$), deuterium ($D^-$) and tritium ($T^-$) but $H^-$ particles will be assumed throughout for convenience.

The proton storage ring comprises magnetic and/or electric field generating means operable to maintain protons in a stable orbit. Protons injected into the ring remain in orbit at a constant radius until extracted. By this means many protons can be stored and output in the form of one or more short high current pulses. The number of protons in any particular orbit is limited by Liouville's theorem; above a critical number the density of protons is such that coulomb forces begin to take effect and the ring starts to blow up. In order to avoid this problem a further pair of accelerating electrodes are placed in the path of the particles after leaving the cyclotron, but before entering the proton storage ring. Suitable accelerating potentials applied to these electrodes can periodically ramp or step change the energy of the particles entering the ring so that they take up a slightly different orbit (higher energy particles will occupy a larger radius orbit). The proton storage ring may thus comprise one or more different orbits, each containing up to the maximum allowed by Liouville's theorem.

Conveniently the plane of the orbit or orbits within the proton storage ring is the same as the median plane of the cyclotron—i.e. that plane in which the particles spiral outwards as they undergo the repeated acceleration within the cyclotron.

Extraction means are provided for extracting protons from the ring when needed. The extraction means may comprise magnetic or electrostatic means, or a mixture of both. For example kicker magnets or septa electrodes may be used, these being placed in such a way as to change the locus of movement of the particles passing around the ring to direct them away from the ring for further use. Such kicker magnets or septa electrodes may be selectively energized when required to extract protons. In the event that several orbits are stored in the storage ring (see above) then all of these may be extracted simultaneously.

The thus extracted beam of protons may be fired against a target, typically of beryllium or lithium, to produce a corresponding neutron beam, if this is what is required.

The particle directing means may take several forms 1, electrostatic or magnetic or a combination of both. In one particularly preferred embodiment, the magnetic field of the cyclotron itself is used to route the particles in said first and, possibly, third stages, with additional bending means, such as a bending magnet, being used to route the particles in said second stage.

In this connection, the present invention is particularly useful for use in superconducting cyclotrons such as that described in International patent application No. WO86/07229. In this cyclotron the magnetic field for the cyclotron is provided by a cylindrical magnet coil defining a cylindrical chamber in which magnetic pole pieces and accelerating electrodes are positioned. The magnetic field extends axially within the cylindrical chamber and is concentrated by said pole pieces to provide an azimuthal variation or "flutter " to compensate for the de-focussing effect of the isochronous field in the axial direction. The median plane of the cyclotron extends orthogonally to the axis of the cylindrical chamber.

If the variation of magnetic field strength with radius is plotted, it will be seen to include (travelling in a direction from the center of the cyclotron) an isochronous region in which the field strength slowly increases to compensate for the relativistic mass increase of the accelerating particles followed, in the air gap between the outer edges of the pole pieces and the cylindrical coil former, by a rapidly falling region which extends a short distance into the wall of the coil former whereupon the field strength reaches zero, thence rises again in the reverse direction at first rapidly but thereafter more slowly until eventually, as the influence of the field starts to diminish, the field strength falls gradually away towards zero.

This negative field region can be used to route the accelerated particles away from the outer cyclotron orbit, once extracted using conventional means. A bending magnet or similar means can then be mounted in a suitable position for collecting the particles routed by the "stray" field of the cyclotron, and bending them back towards the cyclotron. The particles thus leave the bending magnet travelling in a direction having a component of movement towards the cyclotron and reenter the influence of the cyclotron magnetic field. The action of the cyclotron field is now such as to cause the particles to bend away from the cyclotron. At some suitable point in this bending away process, the negatively ionized particles are stripped of their electrons to become protons having a positive charge. As the particles become oppositely charged, they immediately reverse their direction of movement under the influence of the cyclotron magnetic field. Provided conditions are correct, this reversal of direction can cause the protons to continue their movement in a stationary orbit—the proton storage ring—from whence they may be extracted as described above.

BRIEF DESCRIPTION OF THE DRAWINGS

In order that the invention may be better understood, an embodiment thereof will now be described by way of example only and with reference to the accompanying drawings in which.

DETAILED DESCRIPTION OF THE PREFERRED EMBODIMENT

Figure 1:
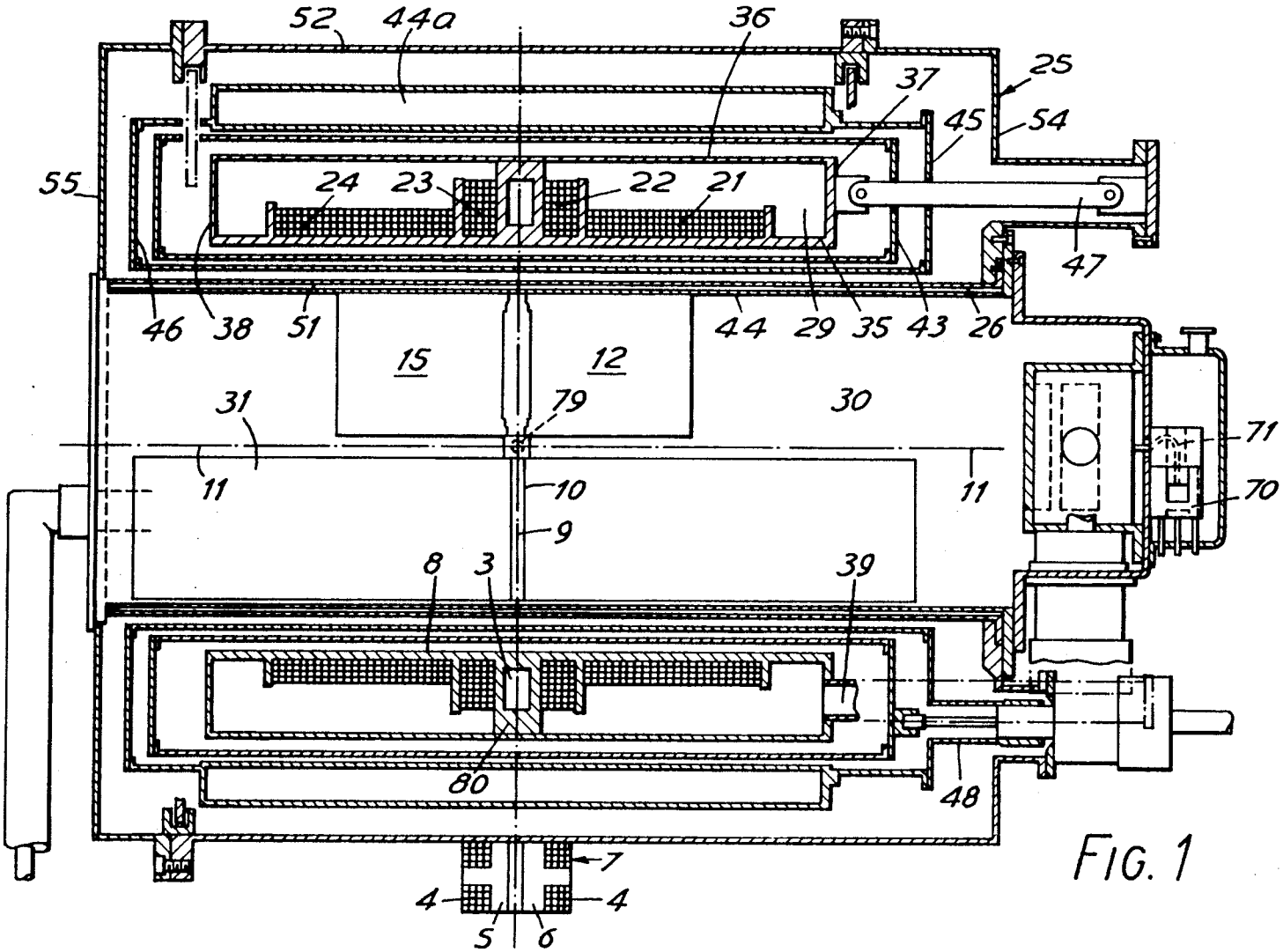
FIG. 1 is a side sectional view of a proton source according to the invention.

Referring firstly to FIG. 1, there is shown a proton source incorporating a cyclotron of the type described in detail in International patent application No. WO86/07229. The accelerating action of the cyclotron is provided to a stream or beam of ionized particles, for example $H^-$ particles, which is continuously injected into the center of a disc-shaped beam space 10.

An axial magnetic field extends parallel to a central axis 11 of the cyclotron (beam space 10 entending radially outwards from the axis 11) and receives azimuthal and radial variations in the region of beam space 10 by interaction with soft iron pole pieces, two of which are illustrated under references 12 and 15 in FIG. 1.

The axial magnetic field is provided by means of a superconducting magnet 29 having a set of superconducting magnet coils 21 to 24 which are housed in a cryostat 25, so that the coils are kept close to absolute zero for superconducting operation. The cryostat 25 is of cylindrical shape and defines a central cylindrical axially extending opening or chamber 26.

The soft iron pole pieces comprise three right-hand pole pieces 12, 13, 14 disposed at 120° intervals around the axis 11 within chamber 26 and three left-hand pole pieces, one of which is shown at reference 15, also disposed at 120° intervals around the axis 11. The left-hand pole piece 15 is aligned axially with right-hand pole piece 12 and the other pole pieces are correspondingly aligned. The three right-hand pole pieces 12, 13, 14 are shown diagrammatically in FIG. 3. The shape, disposition and magnetic properties of the pole pieces are designed and selected so as to provide the desired variations in field strength.

Radio frequency energization is supplied to the beam of particles orbiting in the beam space 10 through radio frequency cavity means in the form of members 30, 31 also disposed in chamber 26. These members comprise a left-hand and a right-hand set of sector-shaped extensions 32, 33, 34 spaced at 120° intervals around the axis 11 of the cyclotron and extending axially upwards from the beam space 10 and radially outwards from the axis 11 and intersposed between respective left-hand and right-hand pole pieces. The left-hand set of extensions is shown diagrammatically in FIG. 3.

The RF energization of the members 30, 31 (accelerating means) causes repeated acceleration of the particles as they spiral around in the median plane 9 of the cyclotron. Full details are given in the aforementioned International Pat. Application No. WO86/07229 and will not be repeated here. When the particles reach the required energization they are removed from the cyclotron by conventional electrostatic and/or magnetic deflection means such as septa electrodes 1, 2 (shown diagrammatically in FIG. 3) and enter the influence of the "stray" magnetic field of the magnet 29, as will be explained in more detail below.

The septa electrodes 1, 2 may be of conventional type and may be protected from particle capture and resultant overheating by a pre-stripper comprising, for example, a carbon fiber etc., positioned in front of the electrodes in the path of the particles. As a result of this, currents in the hundreds of microamps region may be extracted without significant overheating.

The stream of ionized particles is provided by an ion source 70 which is situated to one side of the cyclotron. The ion source 70 emits a stream of negative ions radially outwards; the stream is turned immediately through 90° by the magnetic field and the majority of the concomitant hydrogen gas is removed at this point by differential vacuum pumping. This facility to remove gas easily from the ion stream, along with the facility for extremely efficient pumping of the beam space, contributes to the excellent overall efficiency of this type of cyclotron.

The stream of negative ions from source 70 is shown at 71. It is turned immediately through 90° so as to be directed along the central axis 11 and passes along to the beam space 10. In beam space 10, the ion stream is again turned through 90°, as shown at 79, into the median plane 9, and then starts its orbits in the beam space 10.

The four cylindrical magnet coils 21, 22, 23, 24 in the cryostat 25 are mounted on a cylindrical former 35.

The former 35 along with a cylindrical shell 36 and end plates 37, 38, defines a liquid helium bath having an entry 39 for passage of leads and for pouring in liquid helium so that the coils 21 to 24 operate immersed in liquid helium as superconducting coils. The central web 80 of the former is formed with a continuous ring-shaped cavity for the purpose of providing a proton storage ring 3. This will be described in more detail below.

Also housed within the cryostat is a radiation shield 43 and a double-walled cylindrical container 44 which includes a liquid nitrogen bath **44*a*. The container 44 is suspended from top and bottom plates 45, 46 of the cryostat by arms 48 and the helium bath is suspended from arms 47**, all these suspension arms being made of material which resists the transmission of heat.

The inner and outer cylindrical walls 51, 52 of the cryostat, together with top and bottom plates 54, 55 define a vacuum chamber which is evacuated to resist the ingress of heat.

Attached to the outer wall 52 is a bending magnet 7 comprising opposing pole pieces 5, 6 and coils 4. The bending magnet produces a magnetic field acting transversley across the median plane 9 of the cyclotron, so as to constitute electrostatic and/or magnetic deflection means external to the cyclotron for a purpose to be described.

Figure 2:
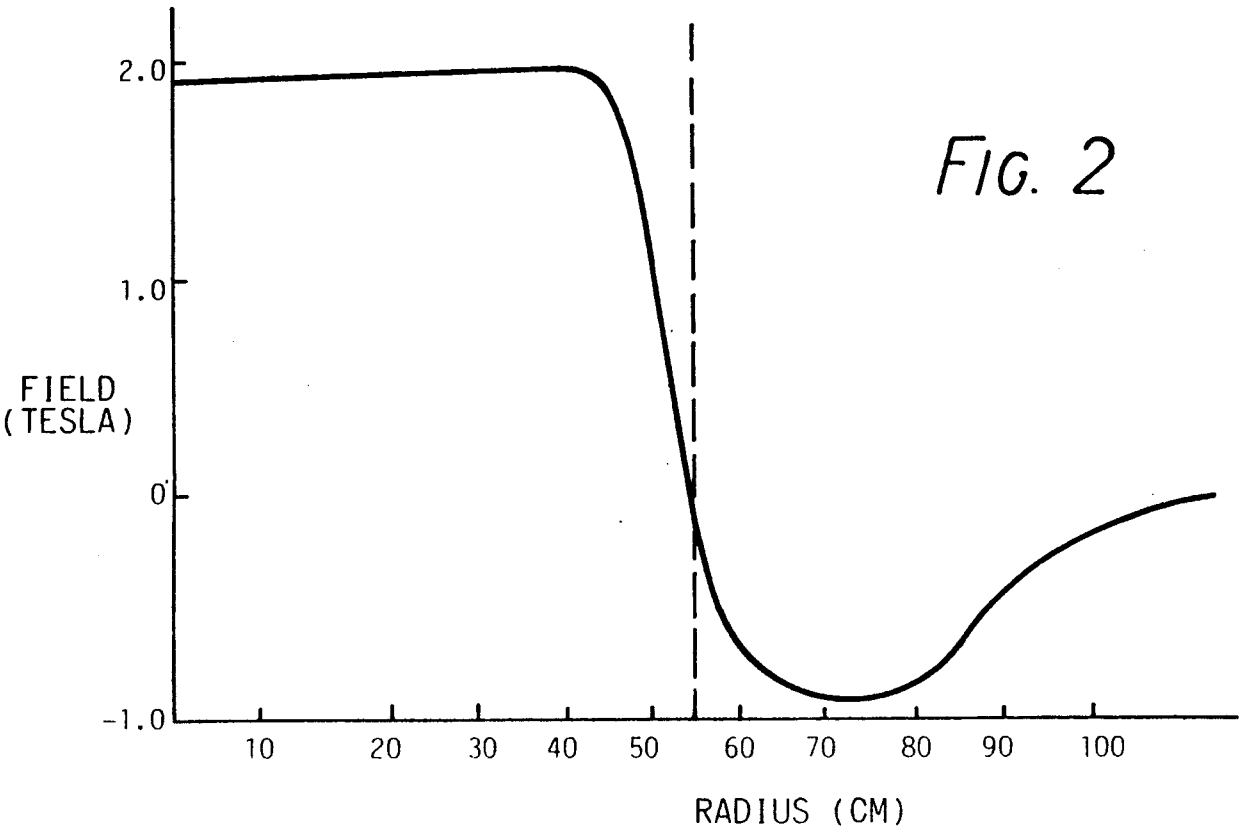
FIG. 2 is a graph of field strength in tesla against radius in cm for the arrangement of FIG. 1.

Referring now to FIG. 2 there is shown a graph of the variation of magnetic field due to magnet 29 with radial distance along the median plane 9 from the axis 11. In the region of 0 to 40 cm, which is the radial extent of pole pieces 12, 17 the field slowly rises to compensate for the relativistic increase in mass which occurs as the particle speed increases. In the region between 40 cm and 60 cm, which is largely air gap, the field falls rapidly with increasing radius until it crosses zero at about 60 cm. This radius corresponds to the inner cylindrical surface 8 of coil former 35 (although the zero point will in practice be slightly beneath the surface—i.e. within the former). Beyond this point, the field strength starts to rise again, but in the negative direction. Beyond 70 cm radius, the negative increase with radius slows down and the field reaches a negative maximum at around 75-80 cm. After this, the field falls towards zero, as the influence of magnet 29 diminishes.

Beyond radius 40 cm—the end of the isochronous field—the field is not directly participating in the operation of the cyclotron and, for the purposes of the present invention is referred to as the "stray" field.

Figure 3:
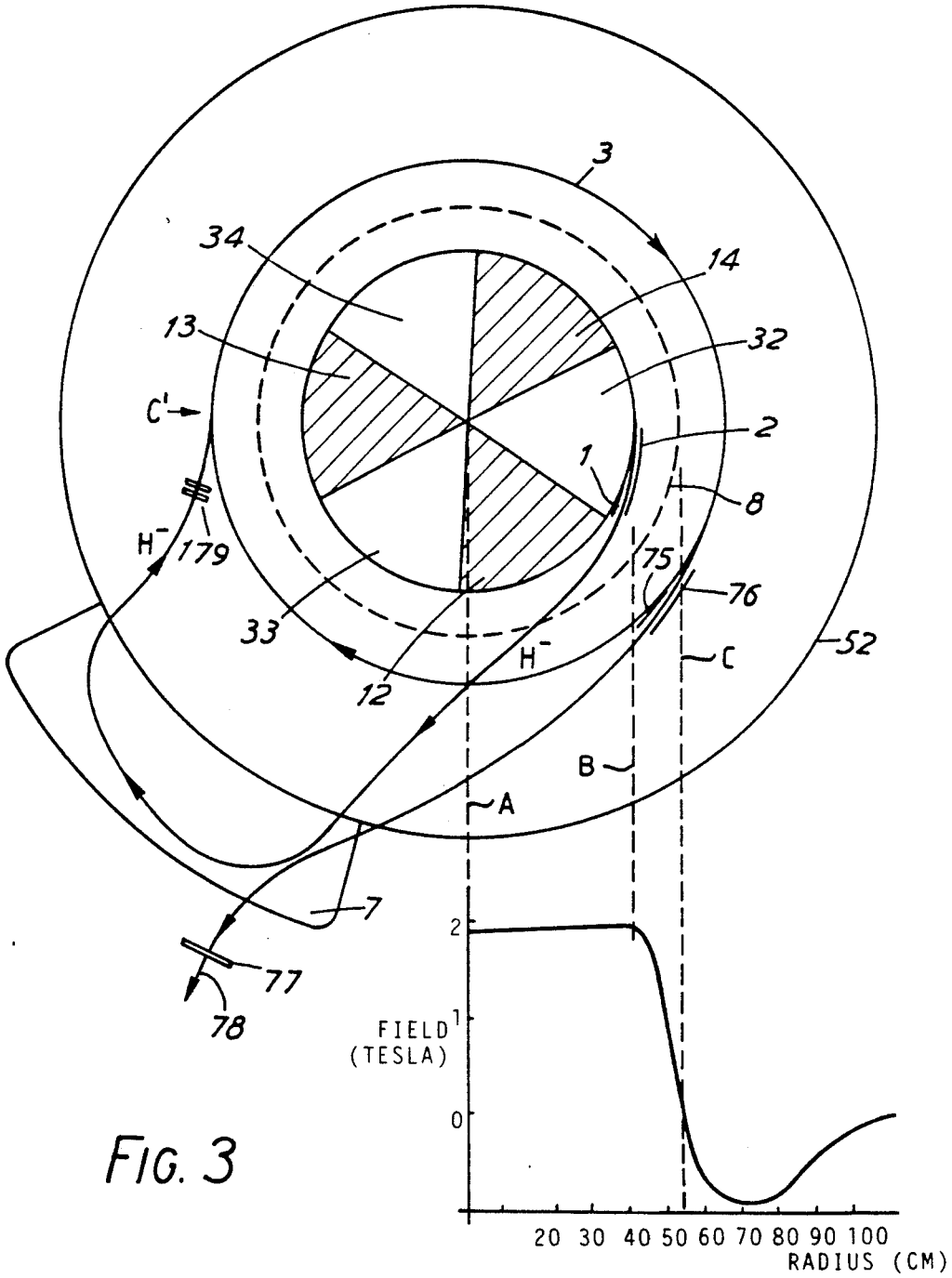
FIG. 3 is a diagrammatic plan view of the proton source shown in conjunction with the graph of FIG. 2.

Referring now to FIG. 3, there is shown the route taken by the particles after leaving the cyclotron. FIG. 3 schematically shows the cyclotron pole pieces 12, 13, 14 and also the position of the bending magnet 7. The plane of FIG. 3 is essentially that of the median plane 9 of the cyclotron shown in FIG. 1. For convenience, a reduced scale reproduction of the graph of FIG. 2 is projected onto the appropriate points in the diagram by dotted lines A, B and C. Line A corresponds to the point in the median plane 9 at which axis 11 crosses; line B represents the radially outer extent of the pole pieces 12 to 14; line C represents the zero field crossover, i.e. the inner surface 8 of coil former 35. Although nominally part of the cyclotron, the extraction septa electrodes 1, 2 are shown diagrammatically in FIG. 3 to illustrate the starting point of the route taken by the $H^-$ particles as they leave the cyclotron.

Under the influence of the rapidly falling, but still positive, magnetic field the particles emerging from the septum constituted by secta electrodes 1, 2 move outwards in a continuing clockwise spiral of rapidly increasing radius. As the field reverses, at about 60 cm radius, the particles begin to turn anticlockwise and soon cross the proton storage ring (represented diagrammatically in FIG. 3 by reference 3). Continuing further outwards, at about 100 cm the particles emerge beyond the outer cylindrical wall 52 of the cryostat and enter the influence of the bending magnet 7, typically of 1.5 Tesla field strength. As shown this overrides the stray magnetic field of the magnet 29 and reverses the anticlockwise movement of the particles, thereby bending the particles back towards the cyclotron axis 11. The particles emerge from the bending magnet 7 at approximately the same radial distance as that which they entered, and soon come under the influence, once again, of the stray magnetic field of magnet 29 which again reverses the rotation to anticlockwise. As the particles are, by this time, moving in a direction back into the stray field, the net result of the stray field is to cause the particles to take an anticlockwise arcuate route, initially with a significant component of movement in the radial direction, but this component falling all the time until eventually the component of movement in the radial direction is zero. If matters are arranged correctly, the point at which the radial component of movement drops to zero corresponds to the radius of the proton storage ring 3. Therefore, if at this point the $H^-$ particles are stripped of their electrons, to become positively charged protons, the direction of motion will once again be reversed and the particles—now protons—will proceed with a clockwise motion at a radius of curvature substantially equal to the radius of curvature of the $H^-$ particles as they entered the ring. This is because the before and after particles, $H^-$ and protons, have equal and opposite charges and have substantially the same mass, and hence momentum. Therefore, if the arrangement is such that the radius of curvature of the locus of movement of the incoming $H^-$ particles is the same as the radial distance from the cyclotron axis 11 to the point at which the radial component of movement of the particles becomes zero, then the locus of movement of the protons will be an arc having a center of curvature coincident with the axis 11 of the cyclotron. By suitable provision of magnetic and/or electric fields, this arc of movement can be maintained at a constant radial distance from the axis 11—in other words a circular locus of movement, coincident with the cavity of storage ring 3—as illustrated in FIG. 3. The storage ring field is basically provided by that part of the field of magnet 29 which acts within the cavity and is shaped by iron segments (not shown) to optimize the storage capacity, with subsidiary electrodes (also not shown) provided as necessary in the known manner.

Electrons can be stripped from the $H^-$ particles by any suitable means, for example, by passing the particles through carbon foil. A suitable position for this is indicated by the arrow C' in FIG. 3.

The output from the cyclotron described in Patent Application WO86/07229 is typically at an energy of 30 MeV and is pulsed at the same frequency as that of the RF energization of members 30, 31 (see above). Typically this frequency is in the region of 40 to 50 MHz. These pulses of particles are applied one after another to the proton storage ring which thus builds up a high circulating proton current. The protons can be released at high current by conventional means such as kicker magnets or, as illustrated, septa electrodes 75, 76, i.e. extraction means comprising magnetic and/or electrostatic deflection means positioned so as to change the locus of movement of the protons passing around the ring 3 to direct them away from the ring 3. These electrodes may be selectively energized, by appropriate means, to extract protons from the ring whereafter the energizing protons come under the influence of the stray negative magnetic field of cyclotron magnet 29. The protons thus bend anticlockwise, as shown and leave the influence of the magnet 29. The protons are directed onto a target 77 of beryllium or lithium which acts as a neutron source, producing a beam 78 of neutrons for further processing. The target 77 is not needed if a proton source only is required.

The route taken by the particles between leaving the cyclotron and entering the proton storage ring and by the protons as they leave the storage ring must be free of direct or near obstruction such as would undesirably affect the free movement of the particles in the required direction. It will be noted that the route taken by the $H^-$ particles from the cyclotron output to the bending magnet 7 crosses the proton storage ring 3 which is in the same plane. This is felt not to be a problem, since the probability of a collision is likely to be very small, and those very few collisions which do occur will not affect operation. If collisions at this point do cause difficulties, it would be a simple matter to avoid direct crossover points by altering the geometry. For example, the plane of the proton storage ring 3 could be changed by suitable bending of the incoming $H^-$ particles out of the plane of FIG. 3.

Also shown in FIG. 3 is a pair of accelerating electrodes 179. The purpose of these is to selectively alter the energy of the $H^-$ particles just as they are about to enter the proton storage ring so that different orbits can be built up within the ring. It has already been mentioned that the number of protons in any one orbit (i.e. at any one energy) is limited. Further attempts to introduce protons into the ring at the same energy will result in blowing up of the ring. To avoid this problem, each orbit in the ring is filled to a level below the maximum, and the accelerator electrodes are then used to alter the energy of the incoming $H^-$ particles so that they occupy a slightly different orbit—i.e. one with a different radius—within the ring 3. When the septa electrodes 75, 76 are energized to extract protons from the ring, all orbits may be taken, so that very substantial currents may be present in the output proton beam.

In practice the output from the proton storage ring 3 will be pulsed, generally at a lower frequency than that of the incoming $H^-$ pulses. A typical output frequency might be 750 Hz. High proton and neutron currents may for example, be required to obtain an acceptable measurement time in associated apparatus. For example, in one application an epithermal neutron source is required in which the pulse frequency is about 750 Hz, and the pulse width about 0.5 $\mu$s. This in turn requires about $3\times10^{15}$ protons/second from the storage ring. If the protons were chopped direct from the cyclotron output, a maximum of about $10^{12}$ protons/second would be achievable which is why the proton storage ring is necessary. By storing the protons, it is possible to eject them at the required pulse rate and intensity.

In this application a ramp waveform having a frequency also of 750 Hz can be used to energize the accelerator electrodes 79. The ramp waveform is synchronized with the extraction pulse waveform applied to the septa electrodes 75, 76 in such a way that the ramp starts from its lowest level at the end of each extraction pulse applied to septa electrodes 75, 76, and continues to rise until the next extraction pulse whereupon it rapidly drops back, during the duration of the extraction pulse, to the lowest level. The process then repeats. In this way protons entering the storage ring 3 at a pulse rate typically of 40 MHz will be subjected to a slightly higher accelerating voltage for each input pulse until the storage ring is emptied by the application of the next extraction pulse to the septa electrodes 75, 76.

I claim:

1. A pulsed proton source comprising a cyclotron having input means for producing a source of negatively ionized particles and accelerating means for accelerating the ionized particles, a proton storage ring coaxial with the cyclotron, means for directing the accelerated particles from said cyclotron along a path which in a first stage passes radially outside said proton storage ring, in a second stage extends back towards the proton storage ring and in a third stage extends tangentially into said proton storage ring, and means at the point of entry of the accelerated particles into the storage ring for converting said negatively ionized particles into protons.

2. A proton source as claimed in claim 1, further comprising extraction means for extracting protons from the storage ring.

3. A proton source as claimed in claim 2, wherein said extraction means comprises magnetic and/or electrostatic deflection means positioned so as to change the locus of movement of the protons passing around the storage ring to direct them away from the ring.

4. A proton sources as claimed in claim 3, wherein said extraction means includes means for selectively energizing said deflection means so as to extract protons from the ring only when needed.

5. A proton source as claimed in any one of claims 2, 3 or 4, further comprising a target positioned to receive the extracted proton beam, said target being such as to produce a corresponding neutron beam.

6. A proton source as claimed in claim 1, further comprising a pair of accelerating electrodes placed in the path of the particles after leaving the cyclotron, but before entering the proton storage ring, power supply means for applying a deflecting potential to said pair of accelerating electrodes, and means for causing said power supply means to apply a periodic ramped or step changed potential to thereby deflect the particles by a different amount, so altering the radius of the orbit within the proton storage ring.

7. A proton source as claimed in claim 1, wherein the means for directing comprises electrostatic and/or magnetic deflection means.

8. A proton source as claimed in claim 7, wherein said cyclotron has means for producing a magnetic field that guides the ionized particles as they are accelerated in the cylclotron by said accelerating means, the magnetic field of the cylclotron being used as at least part of said deflection means.

9. A proton source as claimed in claim 8, wherein the magnetic field of the cyclotron is used to direct particles along at least the first stage of their path of movement.

10. A proton source as claimed in claim 9, wherein the magnetic field of the cyclotron is used to direct particles additionally along the third stage of their path of movement.

11. A proton source as claimed in any one of claims 8 to 10, wherein said means for directing includes electrostatic and/or magnetic deflection means external to the cyclotron and operable to direct particles along the second stage of their path of movement.

12. A proton source as claimed in claim 8, wherein said means for producing a magnetic field comprises a cylindrical magnet coil defining a cylindrical chamber in which magnetic pole pieces and particle accelerating electrodes are situated, said pole pieces being such as to concentrate the magnetic field to provide an azimuthal variation.

13. A proton source as claimed in claim 12, wherein said magnet coil is made of superconducting material, and means are provided for keeping the coil at a temperature, that facilitates superconductivity by the coil.

* * * * *